United States Patent [19]

Banford

[11] Patent Number: 4,502,249

[45] Date of Patent: Mar. 5, 1985

[54] DOORWAY STRUCTURE

[75] Inventor: Dennis W. Banford, Evans, Ga.

[73] Assignee: Peachtree Doors, Inc., Norcross, Ga.

[21] Appl. No.: 519,498

[22] Filed: Aug. 2, 1983

[51] Int. Cl.[3] ..... E05D 15/00; E06B 3/34

[52] U.S. Cl. ..... 49/381; 16/DIG. 40; 16/384; 16/389; 49/399; 49/400; 52/207

[58] Field of Search ..... 49/381, 399, 400; 52/207; 16/384, 382, 389, 392, DIG. 40

[56] References Cited

U.S. PATENT DOCUMENTS

| | | | |
|---|---|---|---|
| 3,183,547 | 5/1965 | Bury | 49/399 X |
| 3,969,846 | 7/1976 | Scott | 16/392 X |
| 4,068,433 | 1/1978 | Glover | 52/207 |
| 4,167,088 | 9/1979 | Governale | 49/381 X |

FOREIGN PATENT DOCUMENTS

| | | | |
|---|---|---|---|
| 412449 | 6/1934 | United Kingdom | 16/389 |

*Primary Examiner*—Philip C. Kannan

*Attorney, Agent, or Firm*—Kimmel, Crowell & Weaver

[57] ABSTRACT

In order to rigidify a doorway structure, one or more fixed doorway panels are anchored at their tops, bottoms and along one vertical edge in the case of an endmost fixed doorway panel. A swinging door is hinged to the other vertical edge of the one or more fixed doorway panels by hinges which carry lateral flanges on corresponding leaves receiving additional diagonal anchor screws which penetrate an adjacent stile to further rigidify the swinging door in its relationship to the fixed doorway panel on which it is mounted.

6 Claims, 3 Drawing Figures

DOORWAY STRUCTURE

BACKGROUND OF THE INVENTION

Doorways or entrances consisting of one or more fixed panels and an attached swinging door on one endmost panel have a tendency as time passes to lose rigidity and generally to weaken, which leads to problems such as sagging of the swinging door to an extent that it will drag on the door still and/or not properly enter the door frame when closed.

Accordingly, the object of this invention is to provide an improved doorway or entrance structure of greater initial rigidity and strength and which rigidity and strength will not tend to be lost to any significant degree during a period of extended use.

In achieving this objective according to the present invention, at least one doorway panel is fixed within a door frame by a series of anchor screws penetrating the top, bottom and one vertical edge of the fixed panel. Along the other vertical edge of the fixed panel, a swinging door is installed by means of hinges whose leaves are attached in the usual manner to the adjacent edges of the swinging door and fixed doorway panel. Additionally, a short lateral flange carried by one leaf of each hinge is apertured to receive diagonal screws which penetrate an adjacent fixed stile of the doorway structure to rigidify the mounting of the hinged door beyond the ability of conventional hinges.

Other features and advantages of the invention will become apparent during the course of the following detailed description.

DETAILED DESCRIPTION

Figure 1:
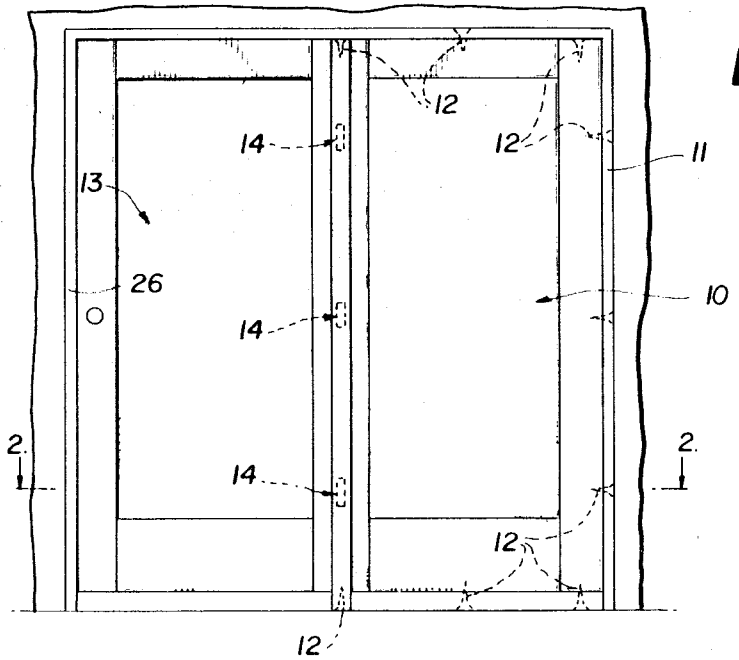
FIG. 1 is an exterior elevation of a doorway structure according to the present invention.
Figure 3:
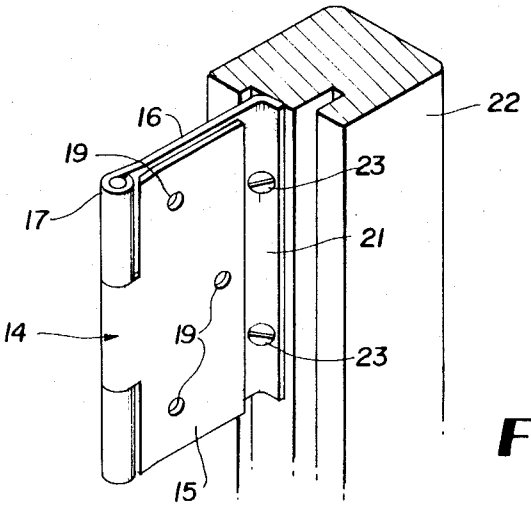
FIG. 3 is a perspective view of a swinging door hinge according to the invention.

Referring to the drawings in detail wherein like numerals designate like parts, a fixed doorway panel 10 of any preferred type if fixedly and securely anchored at one end of a door frame 11 by a series of anchor screws 12 in spaced relationship, which penetrate the edges of the fixed panel 10 along its top, bottom and one vertical edge. While a single fixed doorway panel 10 is illustrated for convenience, it should be understood that two or more of the fixed panels 10 may be provided in the doorway structure in edge-to-edge relationship depending upon the size of the doorway, all of the fixed panels being secured in the manner shown by the screws 12, at least at their tops and bottoms.

To the fixed panel 10 along its other vertical edge or along the corresponding edge of the endmost fixed panel, if more than one such panel is employed, a horizontally swinging door 13 of any preferred type is installed by means of a plurality of vertically spaced door hinges 14, according to a main feature of this invention.

Each hinge 14 includes the customary two leaves 15 and 16 whose knuckles are joined by a pintle 17. The leaf 15 of each hinge is attached to the adjacent vertical edge of the swinging door 13 by screws 18, received through apertures 19 in the leaf 15. Similarly, screws 20 attach the other leaf 16 to the opposing edge of the fixed doorway panel 10.

Each hinge leaf 16, however, is extended beyond the free edge of leaf 15 and terminates in an integral right angular lateral flange 21 extending along the entire length of the hinge parallel to its pintle axis. The flange 21 extends toward the hinged door 13 and rests upon a recessed surface of an adjacent fixed stile 22 of the doorway structure.

At least a pair of spaced anchor screws 23 are placed through apertures 24 located at the bend line of the lateral flange 21 relative to leaf 16. Consequently, the anchor screws 23 penetrate the stile 22 diagonally or at substantially 45° to the vertical plane of fixed doorway panel 10. The screws 23 add substantial additional rigidity to the mounting of the hinged door 13 and to the entire doorway structure, inasmuch as the hinge leaf 16 is now anchored not only to the edge of panel 10 but through the screws 23 to the stile 22, meaning that the stile is also rigidly anchored to the fixed panel 10. The total arrangement described greatly rigidifies the complete doorway structure compared to any structure known in the prior art.

Figure 2:
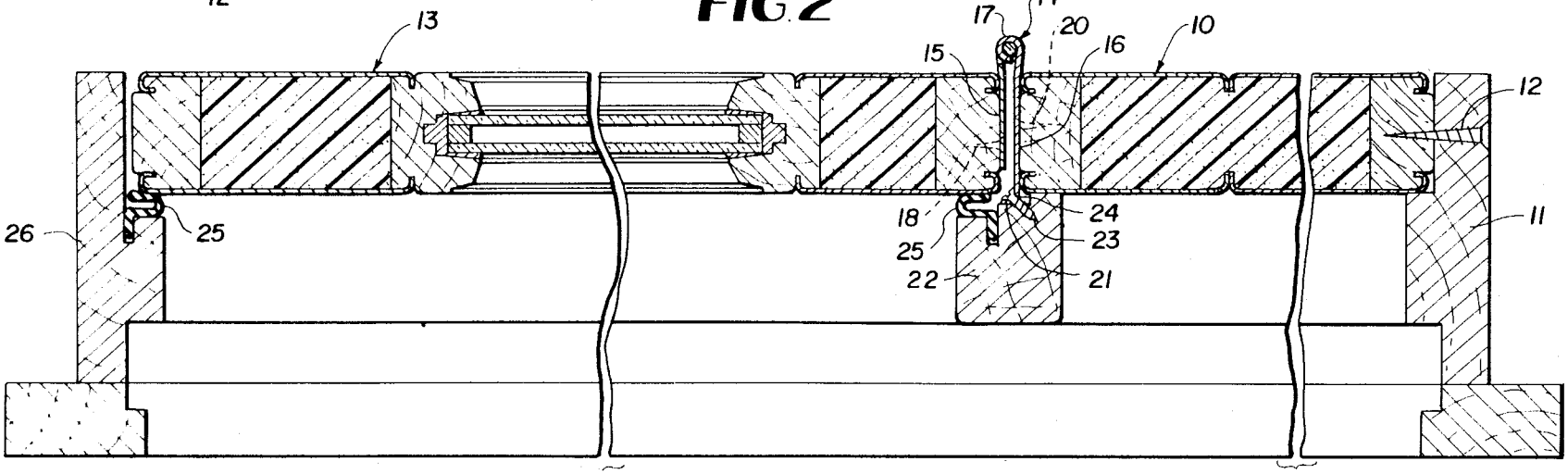
FIG. 2 is an enlarged fragmentary horizontal section taken on line 2—2 of FIG. 1.

The hinged door 13 can be equipped with suitable weather seals 25 as shown in FIG. 2 held in grooves of the stile 22 and vertical frame member 26. Other details of construction shown in the drawings are unimportant to a proper understanding of this invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A doorway structure comprising a frame, at least one fixed doorway panel in said frame, a plurality of spaced fastener elements penetrating said fixed panel at its top, bottom and along one vertical edge and anchoring it within said frame, a horizontally swinging door, spaced hinges mounting said door to the other vertical edge of the fixed panel, each hinge including a leaf attached to a vertical edge of the swinging door and another leaf attached to said other vertical edge of the fixed panel, a lateral flange carried by the last-named hinge leaf, and additional fastener elements anchoring said flange to an adjacent stationary structural member of the doorway structure, thereby tying said structural member through the hinge to said fixed panel while rigidifying the mounting of said swinging door.

2. A doorway structure as defined in claim 1, and said flange extending substantially at right angles to the plane of the last-named hinge leaf and toward the hinged door and the flange being apertured substantially through the bend line of the flange with the last-named hinge leaf, whereby said additional fastener elements are disposed diagonally of the last-named leaf and the plane occupied by the fixed panel.

3. A doorway structure as defined in claim 2, and the additional fastener elements comprising screws.

4. A doorway structure as defined in claim 1, and the first-named spaced fastener elements comprising screws.

5. In a doorway structure, a fixed vertical member, a horizontally swinging door adjacent to said vertical member, a fixed vertical stile adjacent to one edge of the vertical member and a corresponding edge of the swinging door, hinges mounting the swinging door on said vertical member, each hinge having a leaf fixed to the vertical member and another leaf fixed to an opposing vertical edge of the swinging door, a short substantially right angular flange carried by the first-named leaf fixed to said vertical member and substantially engaging a surface of said stile substantially between the opposing vertical edges of said door and fixed vertical member, and spaced fastener elements anchoring said flange to said stile.

6. In a doorway structure as defined in claim 5, and said fastener elements being screws and having their axes disposed diagonally of the stile and fixed vertical member and serving to tie the stile to the fixed vertical member through the hinge and also serving to rigidify the mounting of the swinging door.

* * * * *